US007188790B2

(12) United States Patent
Astachow et al.

(10) Patent No.: US 7,188,790 B2
(45) Date of Patent: Mar. 13, 2007

(54) FUEL-INJECTION VALVE

(75) Inventors: Andrej Astachow, Regensburg (DE); Grit Krüger, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 27 days.

(21) Appl. No.: 10/815,378

(22) Filed: Apr. 1, 2004

(65) Prior Publication Data

US 2004/0195388 A1 Oct. 7, 2004

Related U.S. Application Data

(63) Continuation of application No. PCT/DE02/03725, filed on Oct. 1, 2002.

(30) Foreign Application Priority Data

Oct. 5, 2001 (DE) ..... 101 49 277

(51) Int. Cl.
*B05B 1/30* (2006.01)
*F02M 51/00* (2006.01)
*B05B 1/34* (2006.01)

(52) U.S. Cl. ..... 239/585.1; 239/585.2; 239/585.3; 239/585.4; 239/585.5; 239/533.2; 239/533.4; 239/533.5; 239/533.15

(58) Field of Classification Search ..... 239/585.1, 239/533.15, 533.2–533.9; 238/585.2–582.5
See application file for complete search history.

(56) References Cited

U.S. PATENT DOCUMENTS 4,083,498 A * 4/1978 Cavanagh et al. ..... 239/533.3
4,382,554 A * 5/1983 Hofmann ..... 239/533.9
5,127,584 A * 7/1992 Sczomak ..... 239/533.11
5,639,029 A * 6/1997 Sundholm ..... 239/488
6,055,957 A * 5/2000 Hasegawa et al. ..... 123/305
6,199,539 B1 * 3/2001 Pearlman et al. ..... 123/470
6,220,528 B1 * 4/2001 Cooke et al. ..... 239/533.3
6,467,702 B1 * 10/2002 Lambert et al. ..... 239/533.12
6,655,612 B2 * 12/2003 Oliver ..... 239/585.4
6,758,407 B1 * 7/2004 Lambert et al. ..... 239/5
6,811,105 B2 * 11/2004 Kato et al. ..... 239/533.2

FOREIGN PATENT DOCUMENTS

| | | | |
|---|---|---|---|
| DE | 10005009 | A1 | 8/2001 |
| EP | 1030054 | A2 | 8/2000 |
| EP | 1063416 | A2 | 12/2000 |
| JP | 10252605 | | 9/1998 |
| JP | 10252605 | A * | 9/1998 |

OTHER PUBLICATIONS

PCT International Search Report Application No. PCT/DE02/03725, 8 pages, Mailed Dec. 16, 2003.

* cited by examiner

*Primary Examiner*—Frederick C. Nicolas
*Assistant Examiner*—James S. Hogan
(74) *Attorney, Agent, or Firm*—Baker Botts L.L.P.

(57) ABSTRACT

The fuel injection valve, for an internal combustion motor, has a valve body with injection openings (20) at its point. A valve needle has an axial movement within the valve body, with a conical needle point to give a selective blocking and release of the fuel flow through the injection openings. The point of the valve needle has recessed grooves matching each of the injection openings. The width of each groove matches the diameter of an injection opening, with a stepped contour and a curved cross section.

16 Claims, 3 Drawing Sheets

FUEL-INJECTION VALVE

CROSS-REFERENCE TO RELATED APPLICATION

This application is a continuation of co-pending International Application No. PCT/DE02/03725 filed Oct. 1, 2002 which designates the United States, and claims priority to German application number DE10149277.4 filed Oct. 5, 2001.

TECHNICAL FIELD OF THE INVENTION

The invention relates to a fuel injection valve for internal combustion engines, in particular for internal combustion engines having direct injection.

BACKGROUND OF THE INVENTION

With conventional fuel injectors for injection systems of internal combustion engines, the fuel injection is typically controlled by means of a valve needle which is disposed so as to form a movable seal within a guide in a valve body of an injection valve. At its tip the valve needle has a valve needle seat which, together with a valve body seat of the valve body, opens or closes at least one nozzle orifice to the combustion chamber of the internal combustion engine. The at least one nozzle orifice is typically disposed in the area of the valve body seat.

The purpose of the injection nozzle is to supply the combustion chamber of the internal combustion engine with fuel in a selective and metered manner. The type of fuel conditioning is significantly influenced by the injection nozzle and the progression of the injection operation. This, in turn, can have a major influence of the combustion of the internal combustion engine. With the injection nozzle closed, when the cone of the nozzle needle sits against the conical sealing surface of the nozzle body, the nozzle needle is centered in the nozzle body as a result of this seating contact. However, when the nozzle needle lifts off from the conical sealing surface, the nozzle needle, which then projects freely into the tip of the nozzle body, tends to deviate from the precisely centered position. The consequence of this is that the encircling injection orifices are not released uniformly, which can lead in turn to an asymmetrical jet formation which may have a negative impact on the combustion cycle and consequently also on the emission values.

In order to ensure a uniform jet pattern of the various injection orifices, it is proposed in DE 198 43 616 A1 that the nozzle body of the injection nozzle be provided with a cylinder-shaped recess in the interior of the tip in the area of the injection orifices. By means of the groove the flow is able to bypass the needle seat geometry with minimum flow losses. On the other hand, the introduction of the groove results in an additional so-called damage volume, i.e. a volume between nozzle body and nozzle needle which has a detrimental impact on the engine function with regard to exhaust gas emissions.

SUMMARY OF THE INVENTION

An object of the invention is to provide a fuel injection valve which enables as uniform a jet pattern as possible of the injection orifices with minimal damage volume.

In order to achieve this object of the invention, a fuel injection valve for injecting fuel into the combustion chamber of an internal combustion engine is proposed which comprises a valve body having a tip containing injection orifices and a valve needle which is disposed in an axially displaceable manner in the valve body. A cone at the tip of the valve needle selectively releases and blocks a fuel path to the injection orifices. According to the invention, the tip of the valve needle has a respective groove-shaped recess assigned to each injection orifice.

With this fuel injection valve according to the invention, the volume necessary for favorably directing the flow under the needle seat can be reduced to a minimum. This is achieved in that, instead of a circular groove around the needle tip, only narrow grooves are incorporated in the needle tip.

In one embodiment of the fuel injection valve according to the invention, each recess has a width at least corresponding to a diameter of an injection orifice. In this way the damage volume can be reduced to a minimum, while nonetheless at the same time an optimal redirection of the flow in the direction of the jet surface is still guaranteed.

In order to simplify manufacture, each of the recesses can be formed with a curvilinear or arched contour. A curvilinear or arched contour of this kind can be easily incorporated during the nozzle needle manufacturing process. Thus, for example, an embodiment can provide that the recesses each have a semicircular cross-section.

Preferably the nozzle needle has a longitudinal guide to prevent rotational movements, so that the alignment of the groove in relation to the respective inlet into the tip orifice is guaranteed at all times. A longitudinal guide of the nozzle needle of this kind can preferably be formed by means of a slot-and-key guide so that a rotation of the nozzle needle during operation is prevented at all times.

A further embodiment of the invention can provide that each injection orifice receives a specially adapted groove, by which means asymmetrical flow conditions caused by needle deflections can be compensated for.

The invention consists in the solution of two mutually opposing problems. In order to optimize the flow, an additional volume is created in front of the inlet edges of the injection orifices of an injection nozzle, thereby simultaneously minimizing the damage volume in the blind hole of the nozzle. Fixing the needle in relation to the nozzle body during assembly allows the advantages of both aspects to be realized.

BRIEF DESCRIPTION OF THE DRAWINGS

The invention will now be explained on the basis of embodiments with reference to the accompanying figures.

DETAILED DESCRIPTION OF THE PREFERRED EMBODIMENTS OF THE INVENTION

Figure 1:
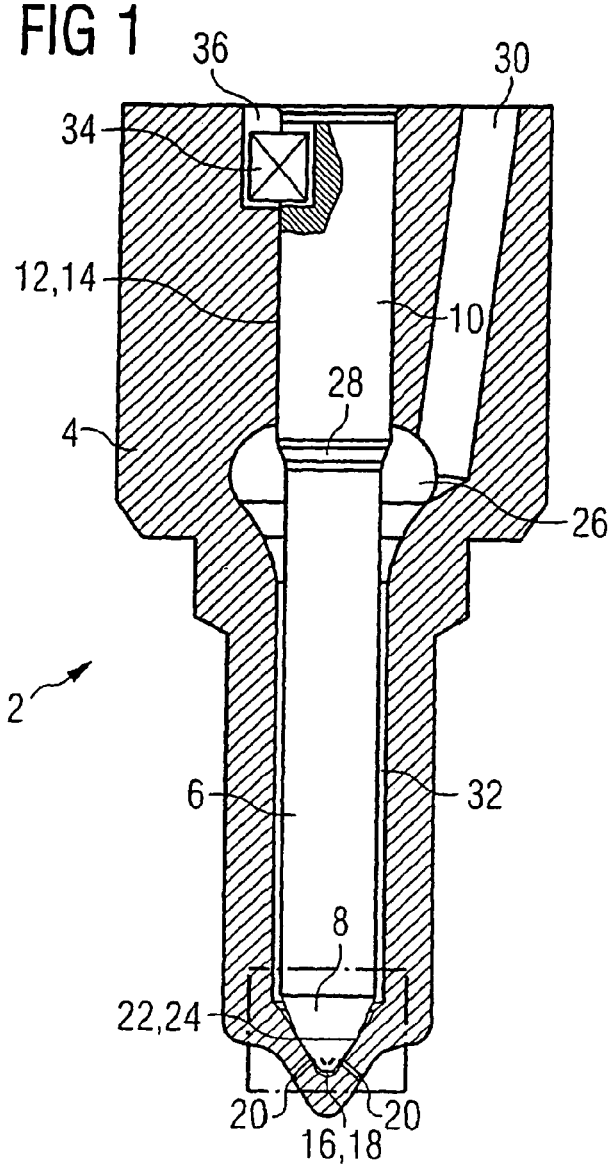
FIG. 1 shows a fuel injection valve according to the invention in a schematic sectional view.

FIG. 1 shows a fuel injection valve according to the invention in a schematic sectional view. The fuel injection valve 2 consists of a valve body 4 and a valve needle 6, which is guided in a sealed manner in a needle guide 10 in the valve body 4. One or a plurality of injection orifices 20 are provided in a blind hole 16 of the valve body 4. The valve needle 6 comprises a needle tip 8 having a seating edge 18 and a valve needle seat 22. This valve needle seat 22 is superimposed on a valve body seat 24 and in this way seals off the injection valve 2 with the injection orifices 20.

The fuel is directed via a fuel feed 30 and an annular pressure chamber 26 disposed between the valve needle 6 and the valve body 4 to the seat edge 18 and, when the valve needle 6 is raised, continues along the annulus 32 between valve needle 6 and valve body via the blind hole 16 and the injection orifices 20 into the combustion chamber of the internal combustion engine.

A sealing gap 14 is disposed between a cylindrically shaped needle guide 10 in the upper area of the valve needle 6, which is larger in diameter relative to the needle shaft, and a guide surface 12 in the valve body 4, which has a cylindrical inner casing surface. As a result of this sealing gap 14 the high pressure prevailing in the pressure chamber 26 decreases constantly relative to a leakage area above the valve needle 6.

A rotation of the valve needle 6 is prevented at all times by means of a featherkey 34 in the upper area of the needle guide 10, which is guided in a corresponding guide groove 36 in the guide surface 12 of the valve body 4. In this way the recesses 38 in the needle tip remain assigned to their respective corresponding injection orifices.

The embodiment of the needle tip 8 including valve needle seat 22 and valve body seat 24 is explained in more detail with reference to FIGS. 3 and 4.

Figure 2:
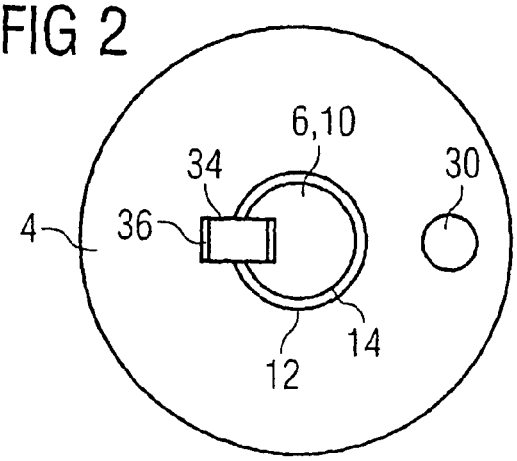
FIG. 2 shows a top view of the fuel injection valve according to FIG. 1.

FIG. 2 shows a top view of the fuel injection valve 2 according to FIG. 1. Clearly recognizable here in particular is the featherkey 34, which fits into a corresponding groove in the upper area of the needle guide 10. The featherkey 34 engages in the correspondingly matching guide groove 36 in the valve body 4, thereby ensuring an axial guidance of the valve needle 6 with minimal play. In this way each recess at the needle tip 8 remains assigned to its respective associated injection orifice 20.

Figure 3:
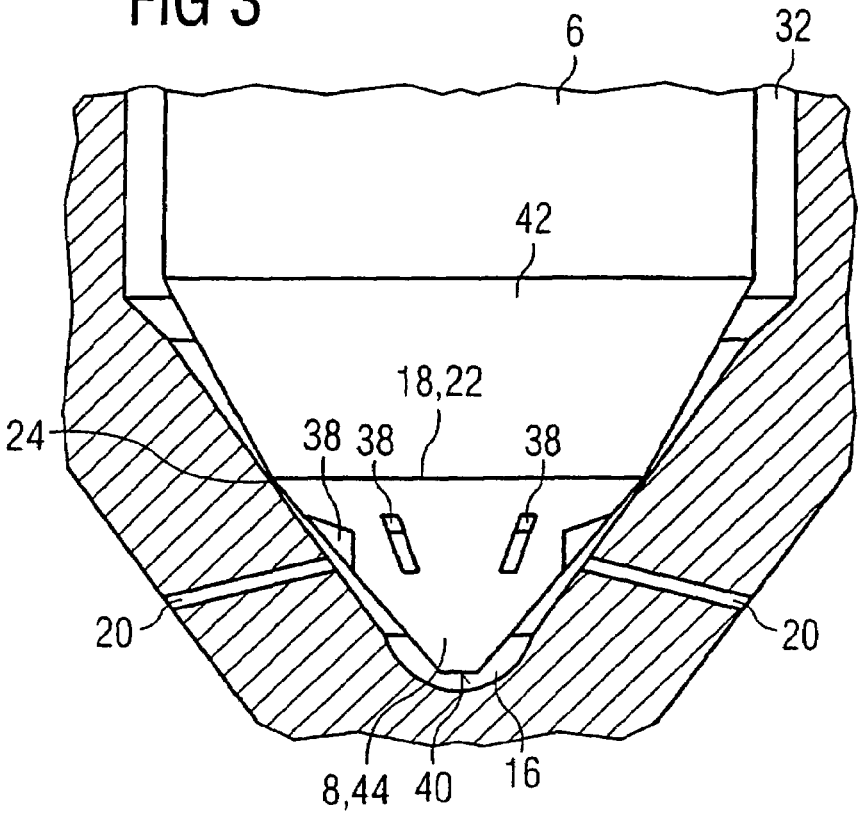
FIG. 3 shows an enlarged section of the needle tip of the valve according to FIG. 1.

FIG. 3 shows an enlarged section of the needle tip 8 of the fuel injection valve 2 according to FIG. 1. At its tip 8 the valve needle 6 has a first tapered cone section 42 with a first angle of taper, said section transitioning into a second tapered cone section 44 with a somewhat more obtuse angle of taper than the first tapered cone section 42. At the end of the needle tip 8 the second tapered cone section 44 is flattened off and delimited by a round end surface 40. The transition between first tapered cone section 42 and second tapered cone section 44 simultaneously constitutes a seating edge 18 which forms a valve needle seat 22. With the valve needle 6 closed, this valve needle seat 22 rests on the valve body seat 24 of the valve body tip. At the lower tip of the of the valve body there are provided a plurality of injection orifices 20, six in number in the exemplary embodiment shown (cf. FIG. 4).

In the second tapered cone section 44, groove-shaped recesses 38 are provided, each of which is assigned to an injection orifice 20 and each of which has approximately the same width as an injection orifice 20. Each of the groove-shaped recesses 38 is triangular in cross-section, whereby a bottom edge of each recess 38 lies approximately at the same height as a bottom edge of an injection orifice 20. The top edge of each recess lies closer to the first tapered cone section 42, so that a fuel flow can proceed virtually swirl-free within the groove and is directed in the direction of the injection orifice 20.

Around the end surface 40 and the tip of the second tapered cone section 44 there is embodied a blind hole 16 in the valve body tip, said blind hole leaving only a very small space when the valve needle 6 is closed, with the result that only a small damage volume is formed in the fuel injection valve 2 according to the invention.

Figure 4:
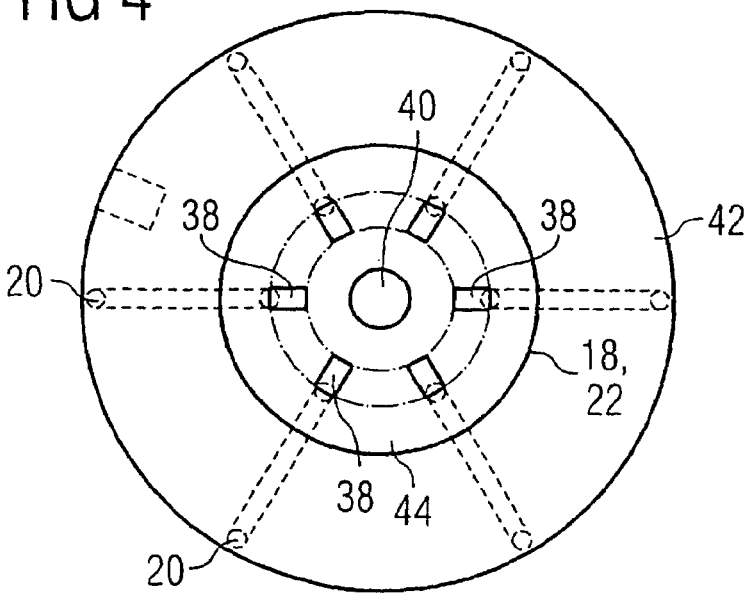
FIG. 4 shows a plan view from below onto the needle tip according to F*igure* 3.

Finally, FIG. 4 shows a plan view from below of the needle tip 8 according to FIG. 3. Clearly visible are the star-shaped symmetrically arranged injection orifices 20, to each of which is assigned a recess 38 on the same longitudinal axis in the second tapered cone section 44 of the needle tip 8.

Figure 5A:
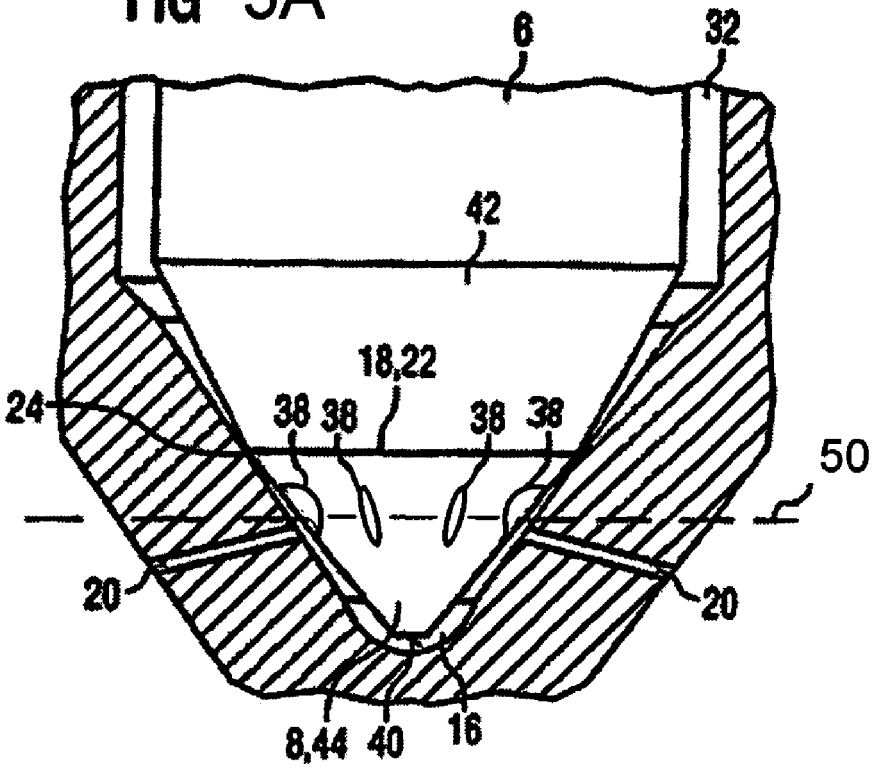
FIG. 5A shows an enlarged section of the needle tip of the valve assembly according to the invention.
Figure 5B:
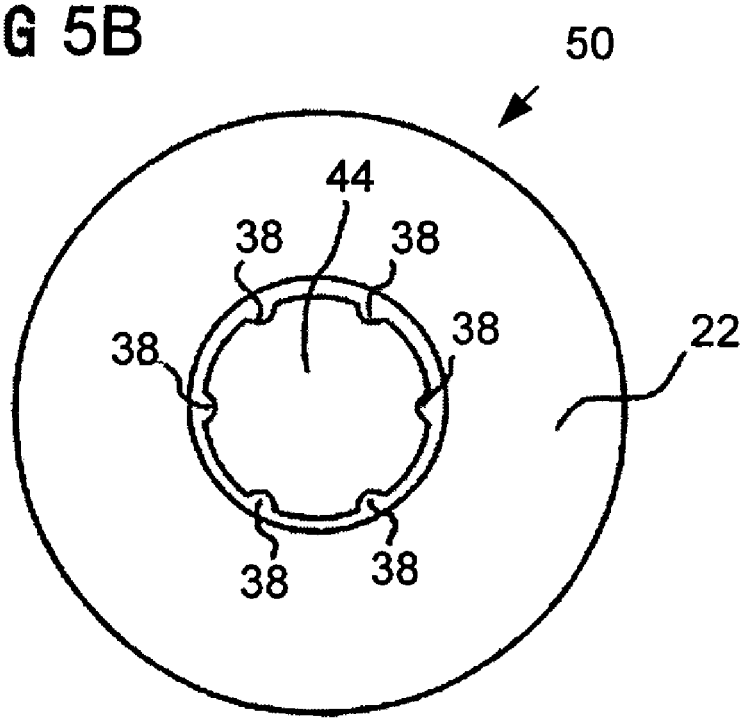
FIG. 5B shows the contour of recesses according to FIG. 5.

FIG. 5A shows an enlarged section of the needle tip having groove-shaped recesses 38 having a semicircular cross-section. As discussed earlier in the specification, the groove-shaped recesses 38 may have a semicircular cross-section and an arched contour to simplify manufacture. FIG. 5B shows the arched contour of the groove-shaped recesses 38 at slice 50.

In a further preferred variant of the invention, each of the recesses 38 has an individual contour. In this way asymmetrical jet patterns of the fuel injection valve 2 due, for example, to a non-centrically guided or laterally deflected valve needle 6 can be equalized. asymmetrical jet patterns of this kind can preferably be determined in experiments and taken into account accordingly in the implementation of the recesses 38.

We claim:

1. A fuel injection valve for injecting fuel into the combustion chamber of an internal combustion engine, said fuel injection valve comprising:

a valve body having a tip, said tip containing injection orifices and a valve needle, said valve needle disposed in an axially displaceable manner in the valve body for opening and closing the injection valve, and a cone located at the tip of the valve needle for selectively blocking a fuel path to the injection orifices, wherein each injection orifice has a respective groove-shaped recess in the cone of the valve needle for simultaneous fuel injection through the injection orifices, wherein at least one of the recesses has a contour different than at least another recess so that the cone is adapted to compensate for asymmetrical flow conditions, wherein the valve needle has a guide for reducing rotational movements.

2. A fuel injection valve according to claim 1, wherein each recess has a width which corresponds at least to a diameter of an injection orifice.

3. A fuel injection valve according to claim 1, wherein each recess has a stepped contour.

4. A fuel injection valve according to claim 3, wherein each recess has a curvilinear cross-section.

5. A fuel injection valve according to claim 1, wherein the guide is a slot-and-key guide.

6. A fuel injection valve according to claim 1, wherein a featherkey engages in a needle guide of the valve needle in a guide groove in a hollow cylindrical guide surface in the valve body.

7. A fuel injection valve according to claim 1, wherein the guide is a longitudinal guide.

8. A fuel injection valve according to claim 1, wherein each recess has an arched contour.

9. A fuel injection valve according to claim 8, wherein each recess has a semicircular cross-section.

10. A fuel injection valve according to claim 1, wherein the recesses are of triangular cross-section.

11. A fuel injection valve according to claim 1, wherein a bottom edge of each recess lies at approximately the same height as a bottom edge of each orifice.

12. A fuel injection valve for injecting fuel into the combustion chamber of an internal combustion engine, said fuel injection valve comprising:

a valve body having a tip, said tip containing injection orifices and a valve needle, said valve needle disposed in an axially displaceable manner in the valve body for opening and closing the injection valve, and a cone located at the tip of the valve needle for selectively blocking a fuel path to the injection orifices, wherein each injection orifice has a respective groove-shaped recess in the tip of the valve needle for simultaneous fuel injection through the injection orifices, wherein at least one of the recesses has a contour different than at least another recess so that the cone is adapted to compensate for asymmetrical flow conditions, each recess corresponding to one injection orifice, wherein the valve needle has a guide for reducing rotational movements.

13. A fuel injection valve according to claim 12, wherein each recess has a width which corresponds at least to a diameter of an injection orifice.

14. A fuel injection valve according to claim 12, wherein a bottom edge of each recess lies at approximately the same height as a bottom edge of each orifice.

15. A fuel injection valve for injecting fuel into the combustion chamber of an internal combustion engine, said fuel injection valve comprising:

a valve body having a tip, said tip containing a plurality of injection orifices and a valve needle, said valve needle disposed in an axially displaceable manner in the valve body for opening and closing the injection valve, and a cone located at the tip of the valve needle for selectively blocking a fuel path to the injection orifices, wherein each of the plurality of injection orifices has a respective one of a plurality of groove-shaped recesses in the tip of the valve needle for simultaneous fuel injection through the injection orifices, wherein at least one of the recesses has a contour different than at least another recess so that the cone is adapted to compensate for asymmetrical flow conditions, wherein the valve needle has a guide for reducing rotational movements.

16. A fuel injection valve according to claim 15, wherein each of the plurality of recesses has a width which corresponds at least to a diameter of an injection orifice.

* * * * *